US006120063A

United States Patent [19]

Petkovsek

[11] Patent Number: 6,120,063

[45] **Date of Patent: *Sep. 19, 2000**

[54] INTEGRAL SPECIAL SERVICE MAILING ASSEMBLY WITH REMOVABLE SPECIAL SERVICE DESIGNATOR SECTION AND A METHOD FOR USING SAME

[76] Inventor: Glenn Petkovsek, 2 Saverne Cir., Little Rock, Ark. 72223

[ * ] Notice: This patent is subject to a terminal disclaimer.

[21] Appl. No.: 09/283,522

[22] Filed: Apr. 1, 1999

Related U.S. Application Data

[63] Continuation-in-part of application No. 08/855,030, May 13, 1997, Pat. No. 5,951,053, which is a continuation-in-part of application No. 08/425,578, Apr. 20, 1995, Pat. No. 5,697,648.

[51] Int. Cl.[7] ..... B42D 15/00

[52] U.S. Cl. ..... 283/61; 283/81; 283/116; 281/2; 281/5; 462/8; 462/64; 462/65

[58] Field of Search ..... 283/2, 5, 116, 283/81, 61; 462/8, 65; 281/2, 5; 40/299, 312, 630

[56] References Cited

U.S. PATENT DOCUMENTS

| | | | |
|---|---|---|---|
| 4,418,865 | 12/1983 | Bowen . | |
| 4,492,334 | 1/1985 | Dicker . | |
| 4,565,317 | 1/1986 | Kranz . | |
| 4,682,793 | 7/1987 | Walz . | |
| 5,183,203 | 2/1993 | Sanders . | |
| 5,190,210 | 3/1993 | Walz . | |
| 5,476,420 | 12/1995 | Manning . | |
| 5,507,526 | 4/1996 | Petkovsek . | |
| 5,697,648 | 12/1997 | Petkovsek | 283/61 |
| 5,746,450 | 5/1998 | Petkovsek | 283/61 |
| 5,848,809 | 12/1998 | Petkovsek | 283/61 |

*Primary Examiner*—Willmon Fridie, Jr.
*Attorney, Agent, or Firm*—Patents & TMS, P.C.

[57] ABSTRACT

An assembly for mailing an article requiring special services and a method for mailing same are provided. The assembly includes a single sheet constructed in such a way that one portion of the sheet provides a label and the other portion provides a return postcard or other special service form for attachment to an envelope in its assembled position. The return postcard is integrally formed and removably attached such that the return postcard remains attached to the envelope until received by the addressee, at which time the return postcard may be removed. The assembly is designed to incorporate a form into the return postcard to simplify preparation of the mailpiece for delivery by the special service. Further, removably attached to the return postcard is a special service designator section that may be removed and applied to the mailpiece to aid in the delivery of the mailpiece.

20 Claims, 10 Drawing Sheets

INTEGRAL SPECIAL SERVICE MAILING ASSEMBLY WITH REMOVABLE SPECIAL SERVICE DESIGNATOR SECTION AND A METHOD FOR USING SAME

This application is a continuation-in-part of U.S. patent application Ser. No. 08/855,030 filed May 13, 1997, now U.S. Pat. No. 5,951,053 which is a continuation-in-part of U.S. patent application Ser. No. 08/425,578 filed Apr. 20, 1995, which issued as U.S. Pat. No. 5,697,648 on Dec. 16, 1997.

BACKGROUND OF THE INVENTION

The present invention generally relates to a form for mailing an article requiring special services. More specifically, the present invention relates to an integral special service mailing assembly for mailing an article requiring special services having a return receipt postcard and a label indicative of the special service and a method for using same.

It is, of course, generally known to mail an article requiring special services for delivery of the article, such as certified mail, registered mail, insured mail, COD, return receipt for merchandise and the like. Known components and methods for assembling a mailer for mailing an article requiring special services have multiple, separate components requiring attachment to an exterior of an envelope for the special services delivery of the article.

For example, when a customer of the U.S. Postal Service desires that an article be mailed by certified mail, for instance, an envelope containing the article is provided to the postal employee by the customer. The postal employee is then required to attach or otherwise provide the envelope with a permanent seal or label indicating that the envelope is to be delivered by certified mail.

Then, a return receipt postcard must be attached to the envelope. The postcard must be completed by the postal employee and/or the customer mailing the envelope containing the article. Some postcards include areas having an adhesive for attaching the postcard to the envelope. Other postcards require separate attachment, by using tape, for example.

Such a procedure is both complex and time-consuming, as well as labor intensive. The procedure requires the postal employee to ensure that all of the appropriate labels and documents are affixed to the envelope prior to delivery of the article. Therefore, the appropriate forms, labels and the like must be adequately stocked and available for the postal employee's use. Further, the postal employee must ensure that all articles are appropriately affixed to the envelope. In addition, the return receipt postcard must be suitably affixed to the envelope so that the return postcard is not removed during the mailing of the article to its destination. Of course, it should be understood that an envelope prepared for special service mailing may be prepared by any individual, not just a postal employee.

A need, therefore, exists for an improved integral special service mailing assembly requiring special services, such as certified mail, insured mail, registered mail, COD, return receipt for merchandise and the like, and a method for using same.

SUMMARY OF THE INVENTION

The present invention provides an assembly and a method for using same for mailing an article requiring delivery by a special service, such as for certified mail, insured mail, register mail, COD, return receipt for merchandise and the like.

In an embodiment of the present invention, an assembly is provided having a backing sheet and a layer attached to the backing sheet by an adhesive. The layer includes a return postcard and a designator section indicative of a special service. The designator section is contained within exterior sides that define the return postcard. The designator section may be removably attached to the return postcard.

In an embodiment, the assembly has a first anchor portion associated with the layer extending outside one of the exterior sides of the return postcard. The first anchor portion has the adhesive on a back side of the first anchor portion removably attached to the backing sheet.

In an embodiment, an area is provided within the designator section that has a machine readable code.

In an embodiment, the designator section is distinctly colored from a remainder of the return postcard.

In an embodiment, the special services includes certified mail, registered mail, insured mail or return receipt for merchandise mail.

In an embodiment, a second anchor portion is attached to the return postcard outside one of the exterior sides of the return postcard. The second anchor portion has the adhesive on a back side of the return postcard.

In an embodiment, an auxiliary label is connected to the return postcard.

In an embodiment, a tear line separates the first anchor portion from the return postcard.

In an embodiment, a tear line separates the auxiliary label from the return postcard.

In an embodiment, an adhesive is provided on a back side of the auxiliary label.

In an embodiment, a tracking strip extends outside one of the exterior sides of the return postcard.

In another embodiment of the present invention, a method is provided for preparing a mailpiece for delivery by a special service. The method comprises the steps of: providing a backing sheet; attaching a layer including a return postcard to the backing sheet wherein the return postcard has a special service designation section within exterior sides that define the postcard; removing the layer from the backing sheet; and attaching the layer to the mailpiece to effect the delivery by the special service. The special service designation section may be attached to the mailpiece to effect the delivery by the special service.

In an embodiment, an anchor portion is provided adjacent the return postcard.

In an embodiment, an auxiliary label is provided adjacent the postcard.

In another embodiment of the present invention, a mailing label is provided for preparing a mailpiece for delivery by a special service. The label has a backing layer and includes a first portion with adhesive backing and a second portion without adhesive. The second portion includes a return postcard having a designation section wherein the designation section is distinctly colored from a remainder of the return postcard to identify a type of the special service. The designator section may be removably attached to the return postcard.

In an embodiment, an auxiliary label is attached to the first portion of the label. The auxiliary label has an adhesive backing.

In an embodiment, a receipt is attached to the label. The receipt has no adhesive backing.

In an embodiment, a tear line is arranged for separating the first portion from the second portion.

In an embodiment, the designation section is suitable for designating certified mail, insured mail, registered mail or return receipt for merchandise.

In an embodiment, an additional special designation label is provided exterior to the return postcard wherein the additional special designation label has an adhesive back side.

It is, therefore, an advantage of the present invention to provide an improved assembly for mailing an article requiring delivery by a special service.

Another advantage of the present invention is to provide a simplified method for mailing an article requiring special services.

And, another advantage of the present invention is to provide an assembly that is integrally formed as a complete unit for mailing and labeling of an article requiring special services.

Yet another advantage of the present invention is to provide an assembly and a method for mailing an article requiring special services without requiring additional adhesives or fixatives for attaching the same to the mailpiece.

Moreover, an advantage of the present invention is to provide an assembly and a method for mailing an article requiring special services that is substantially foolproof.

Yet, a further advantage of the present invention is to provide an assembly which works on automated printing equipment.

And, another advantage of the present invention is to provide an assembly including a label and a form that provides for pre-imaging or pre-printing of variable information thereon.

Yet another advantage of the present invention is to provide an assembly with a removable special services designator section.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention provides an integral special service mailing assembly for mailing an article requiring special services. Further, the present invention provides a method for using the assembly for mailing articles requiring special services.

Figure 1:
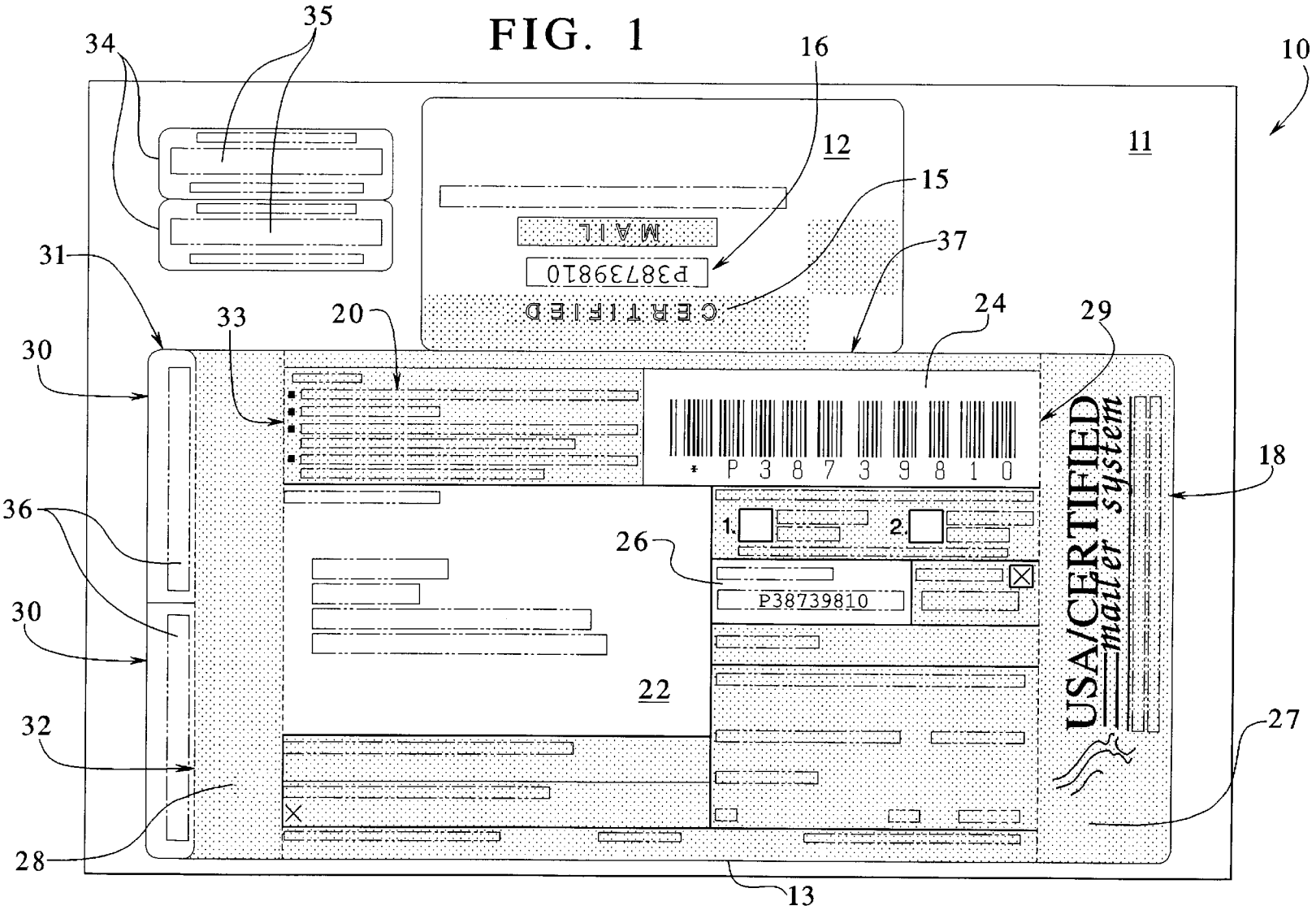
FIG. 1 illustrates a plan view of a front side of an embodiment of an assembly of the present invention.
Figure 4:
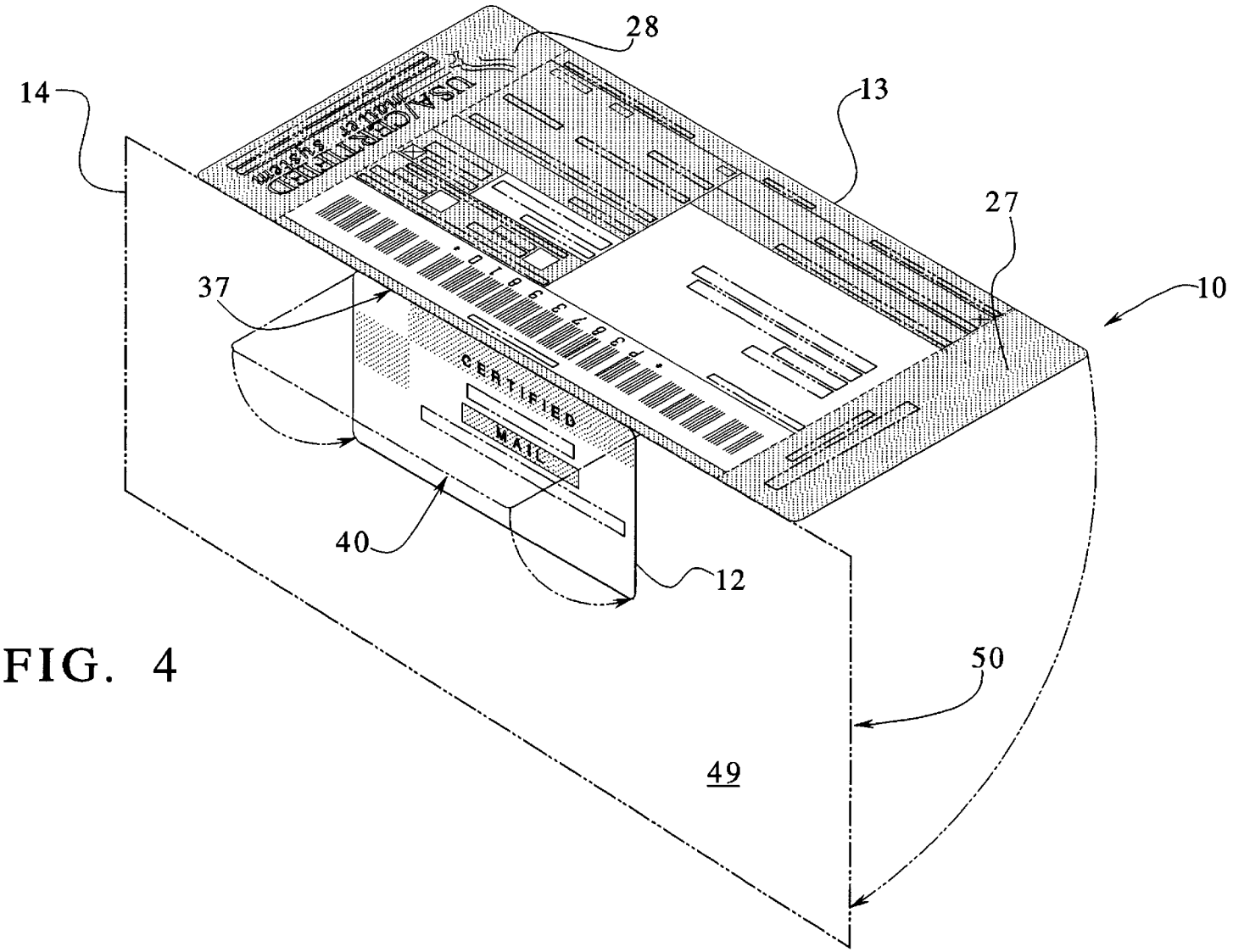
FIG. 4 illustrates a perspective view of a front side of an embodiment of the assembly of the present invention with an article to be mailed using same.

Referring now to the drawings, wherein like numerals refer to like parts, FIG. 1 is a front plan view that generally illustrates an embodiment of an assembly 10 formed from a single sheet 11 to provide both a label 12 and a return postcard 13. The assembly 10 is capable for use in mailing an article 14 requiring a special service as shown in FIG. 4. Although a certified mail envelope is illustrated, it should be understood that the present invention is applicable to any mailing item requiring special services, such as insured mail, registered mail, COD, return receipt for merchandise and the like.

The front side of the embodiment of the assembly 10 illustrated in FIG. 1 includes the label 12. The label 12 is, in a preferred embodiment, a pre-printed label indicative of the special service required for mailing of the article 14. The label 12 is preferably preprinted directly on the sheet 11. The pre-printed label 12 includes a special service indicator 15 and a window section 16 in which an article identification number can be printed.

The assembly 10 also has a front bottom portion 18 that includes the return receipt postcard 23 that can be similar to United States Postal Service form PS-3811. The return receipt postcard 13 may include a set of instructions 20 for the sender, as well as an article addressee section 22 for pre-printing the addressee's address. The return receipt postcard 13 also has a document control number bar code 24 to aid in tracking of the article 14.

In addition, the return receipt postcard 13 has a number of sub-sections requiring completion by the sender prior to mailing. One sub-section illustrated at numeral 26 includes a machine readable article identification number corresponding to the number in the window section 16 of the pre-printed label 12. The sub-section 26 may have a background color that contrasts with the color of the return receipt postcard 13 so as to simplify the reading of the machine-readable code in the sub-section 26. Other sections, as well, may include similar color-contrasting portions within the return receipt postcard 13.

Another section of the bottom portion 18 of the assembly 10 is, in a preferred embodiment, a first anchor portion 27 at one end of the return receipt postcard 13 and a second anchor portion 28 at the opposite end. The first anchor portion 27 is separable from the return receipt postcard 13 by means of a perforated tear line 29.

The second anchor portion 28 includes at least one article tracking label 30 provided along a detachable strip 31 at the opposite end of the bottom portion 18 of the assembly 10 and is removable from the bottom portion 18 by a perforated tear line 32. The second anchor portion 28 is also separable from the return receipt postcard 13 by tearing along a perforated tear line 33.

The article tracking label 30 may be adhesively backed for subsequent attachment to a receipt or other item requiring designation of the article number for related purposes. As illustrated, two tracking labels 30 are provided in the embodiment shown. For example, one of the tracking labels 30 may be used by a postal delivery employee on a postal form PS 3849, a delivery notice, (not shown). The second tracking label 30 may be used for the receiver's record use.

In addition, in the embodiment shown, two additional tracking labels 34 are provided. The two additional tracking labels 34, which also include a section 35 for the article identification number, may be used for the sender's records.

The certified article number tracking labels 30 can also be used for the sender's and receiver's record keeping and/or accounting use. Each tracking label 30 has the section 33 for the article identification number. The tracking label 30 may be provided with adhesive on its reverse side. The tracking label 30 may also be a peel and stick type label.

Thus, the bottom portion 18 of the assembly 10 includes three main sections: the return receipt postcard 13 and the first and second anchor portions 27, 28. In addition, the tracking labels 30, 34 are provided. The label 12 is separated from the return receipt postcard 13 by a score line 37 to facilitate separation of the postcard 13 upon delivery of the article 14. As mentioned above, the return receipt postcard 13 has a number of sub-sections requiring completion by the sender prior to mailing the article 14. After delivery of the article 14, the return receipt postcard 13 is detachable from the first and second anchor portions 27, 28 by tearing along the perforated tear lines 29, 33 respectively.

An advantage of the present invention is that a number of the sub-sections of the return postcard 13 and the label 12 discussed above can be pre-printed when the assembly 10 of the present invention is used.

Figure 2:
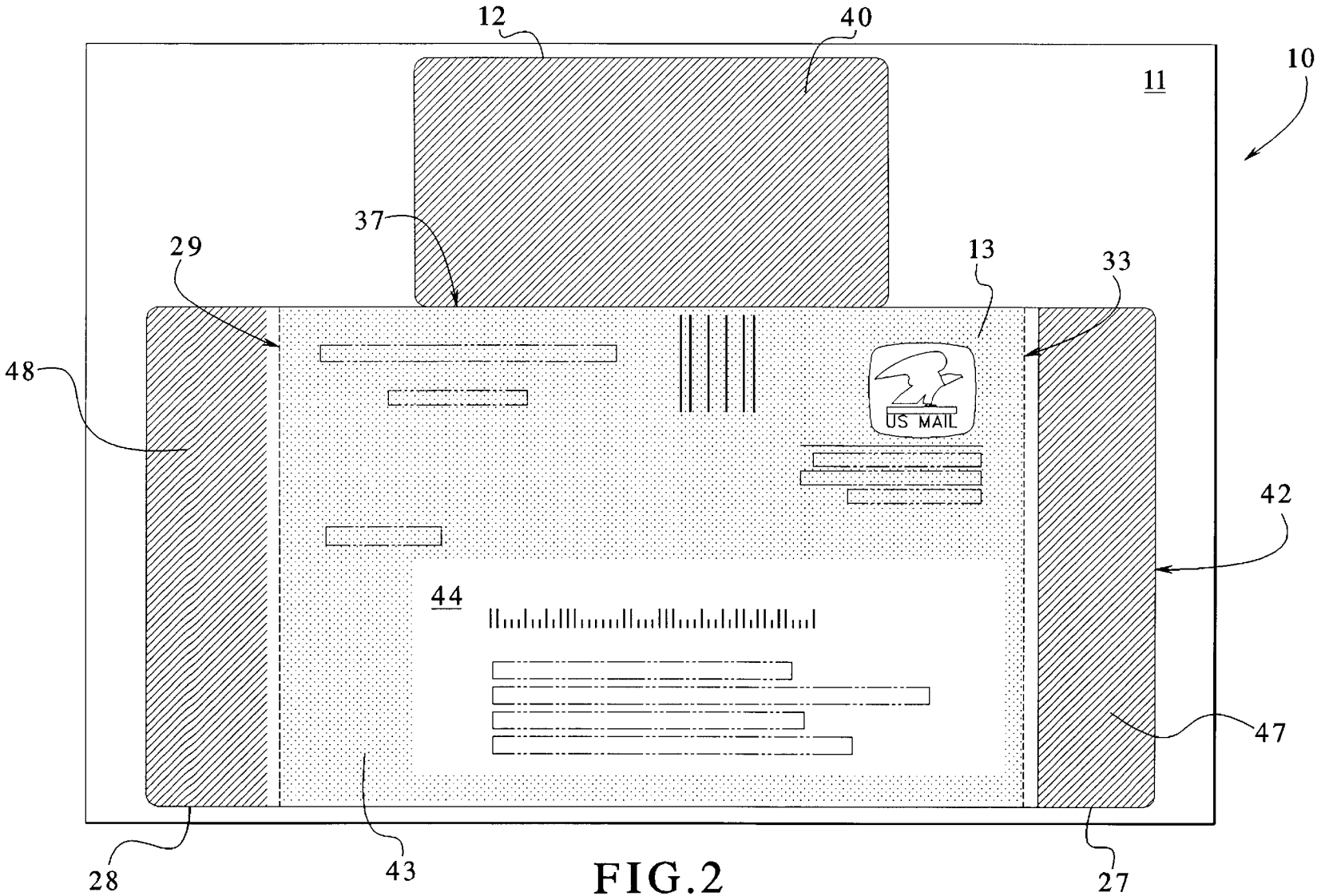
FIG. 2 illustrates a plan view of a back side of an embodiment of the assembly of the present invention.

Referring now to FIG. 2, a back plan view of an embodiment of the assembly 10 is illustrated. The reverse side of the label 12 shown in FIG. 1 has an adhesive portion 40. The adhesive portion 40 may be a peel and stick type adhesive and is provided to seal the label 12 to the article 14 requiring special service mailing as shown in FIG. 4.

A back bottom portion 42 of the assembly 10 includes a front side 43 of the return receipt postcard 13. The return receipt postcard 13 includes a "Return To" section 44. The "Return To" section 44 may be color-contrasted with the remainder of the return receipt postcard 13 to enable simplified reading of the "Return To" section 44.

The score line 37 is provided along the top side of the return receipt postcard 13. For subsequent detachment of the return receipt postcard 13, the perforated tear lines 29, 33 are provided along the edges adjacent to the anchor portions 27, 28. The first anchor portion 27 has a first adhesive portion 47 and the second anchor portion 28 has a second adhesive portion 48 to adhere the back bottom portion 42 to the article 14 prior to mailing.

Figure 3:
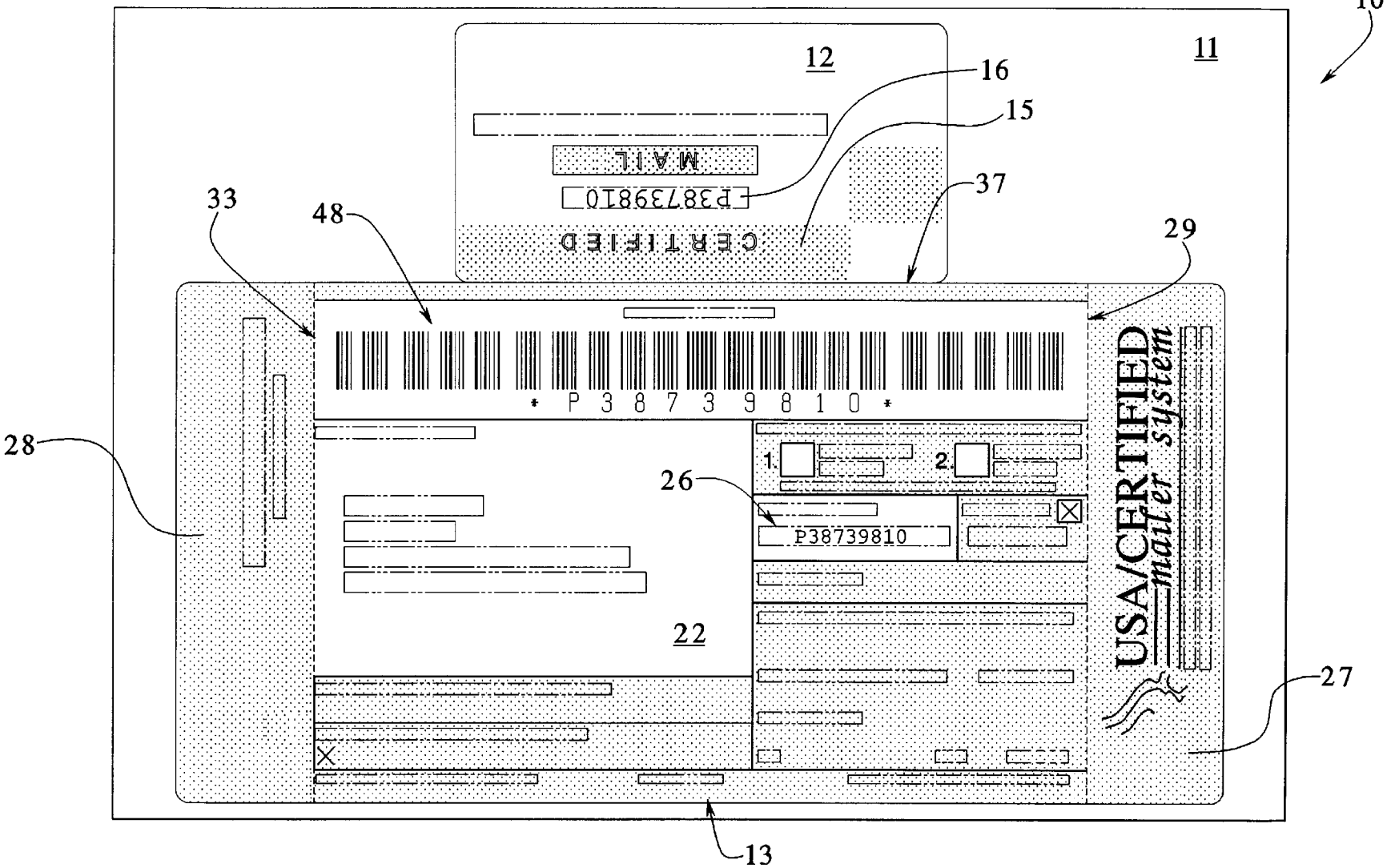
FIG. 3 illustrates a plan view of a front side of another embodiment of the assembly of the present invention.

FIG. 3 shows another embodiment of the assembly 10 of the present invention, wherein like numerals represent like parts. This embodiment is a simplified version of the prior embodiment in that it does not have the instruction section 20 nor does it have the tracking labels 30, 34. However, the embodiment illustrated in FIG. 3 as an enlarged bar code region 48 for easier reading during high speed processing. The embodiment of the present invention illustrated in FIG. 3 is shown in use in FIG. 4.

Referring now to FIG. 4, the article 14 requiring special service, shown from its front side, is shown. The pre-printed label 12 is shown having the window section 16 in which the certified mail number is printed either manually or automatically. As illustrated, the label 12 folds down onto a front side 49 of the article 14 requiring special service mailing. The label 12 is adhered to the front side 49 of the article 14 by means of the adhesive portion 40 located on the back side of the label 12 (see FIG. 2). Also as illustrated in FIG. 4, the bottom portion 18 of the assembly 10, including the anchor portions 27, 28 and the return receipt postcard 13, is sealed to a back side 50 of the article 14 and the anchor portions 27, 28 are sealed to the article 14 by the adhesive portions 47 and 48, respectively. Also, the score line 37 is located at the top of the article 14 to provide for easier subsequent separation of the return receipt postcard 13 from the anchor portions 27, 28 and the label 12 upon delivery of the article 14.

Figure 5:
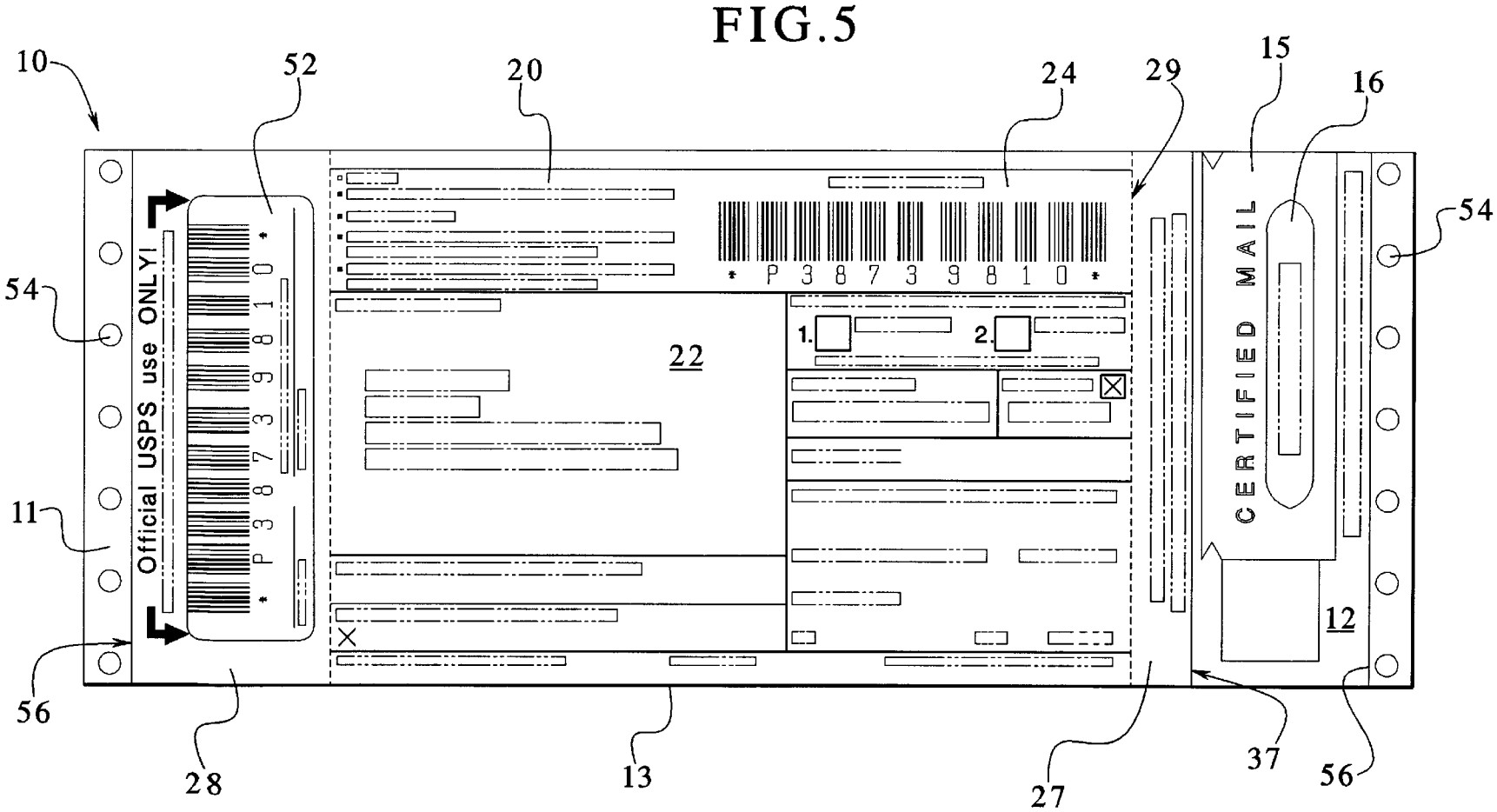
FIG. 5 illustrates a plan view of a front side of another embodiment of the assembly of the present invention.
Figure 6:
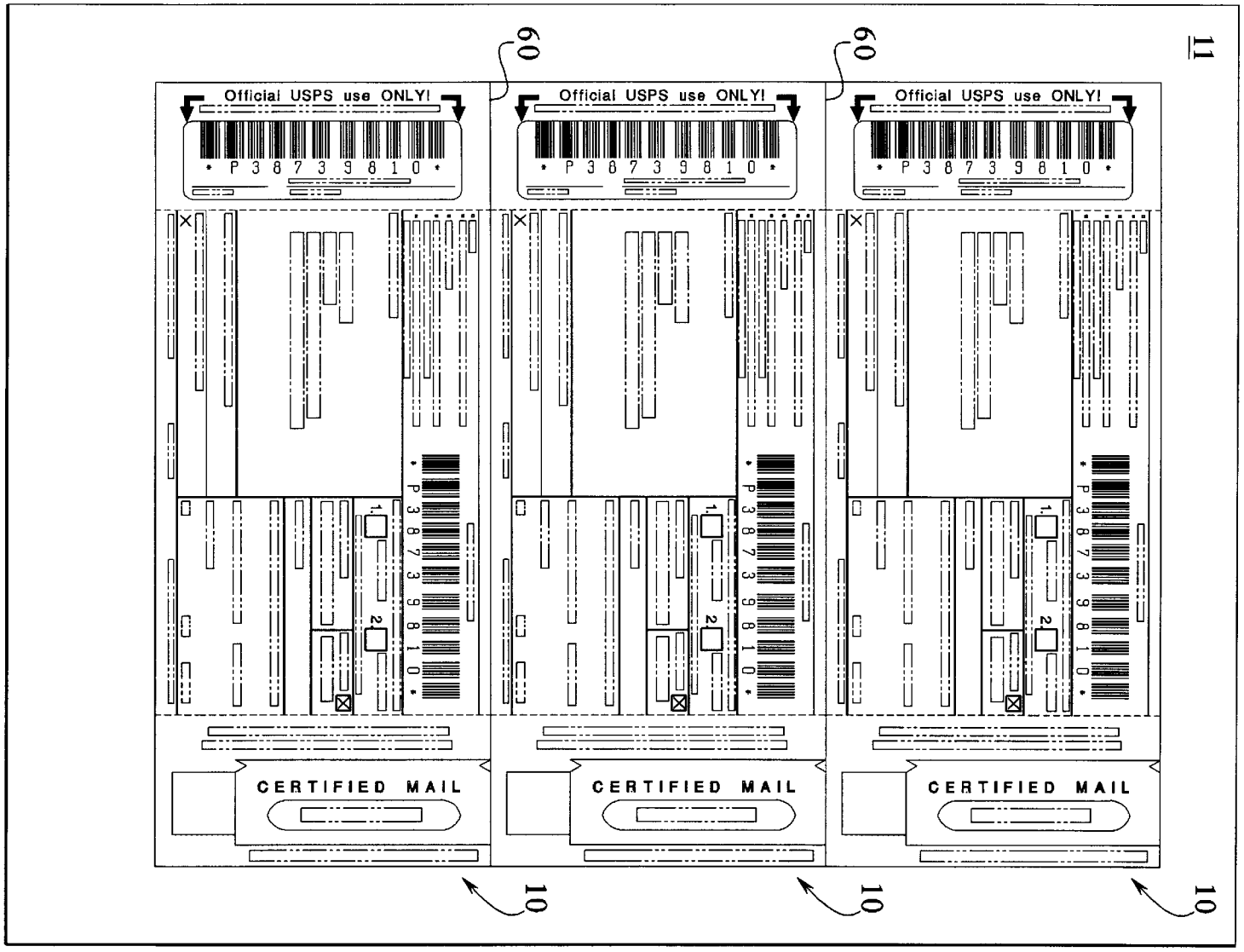
FIG. 6 illustrates another embodiment of the assembly of the present invention in which a plurality of assemblies are located on a single sheet.

FIG. 5 illustrates another embodiment of the assembly 10 of the present invention. In the embodiment shown in FIG. 5, the orientation of the label 12 with respect to the postcard 13 is changed. However, like numerals represent like parts and the score line 37 between the label 12 and the postcard 13 is shown located between the label 12 and the return receipt postcard 13. In addition, a tracking indicator 52 is provided on the second anchor portion 28. Another variation in the embodiment shown in FIG. 5 is that the sheet 11 has a plurality of tracker holes on the edges thereof for use in a printer having tracking wheels to advance the paper. The tracking holes 54 are located on a tracking strip 56. In addition, a plurality of the assembly 10 can be provided on a single sheet 11 as shown in FIG. 6. Each assembly 10 is separable from the adjacent assembly 10. This can be accomplished by a score line 60. In such a case, it would be preferred that the assembly 10 be a peel and stick type assembly that is removably attached to the sheet 11. Thus each individual assembly 10 could be detached from the sheet 11 as needed. Also the entire sheet could be printed at one time for subsequent separation and application to separate articles 14.

The assembly 10 can be printed using any known method of printing and is not limited to any single type. Such printing methods include, but are not limited to, laser printing, thermal printing, dot matrix printing and the like. Printing may be performed on continuously fed forms or on individually fed forms.

Figure 7:
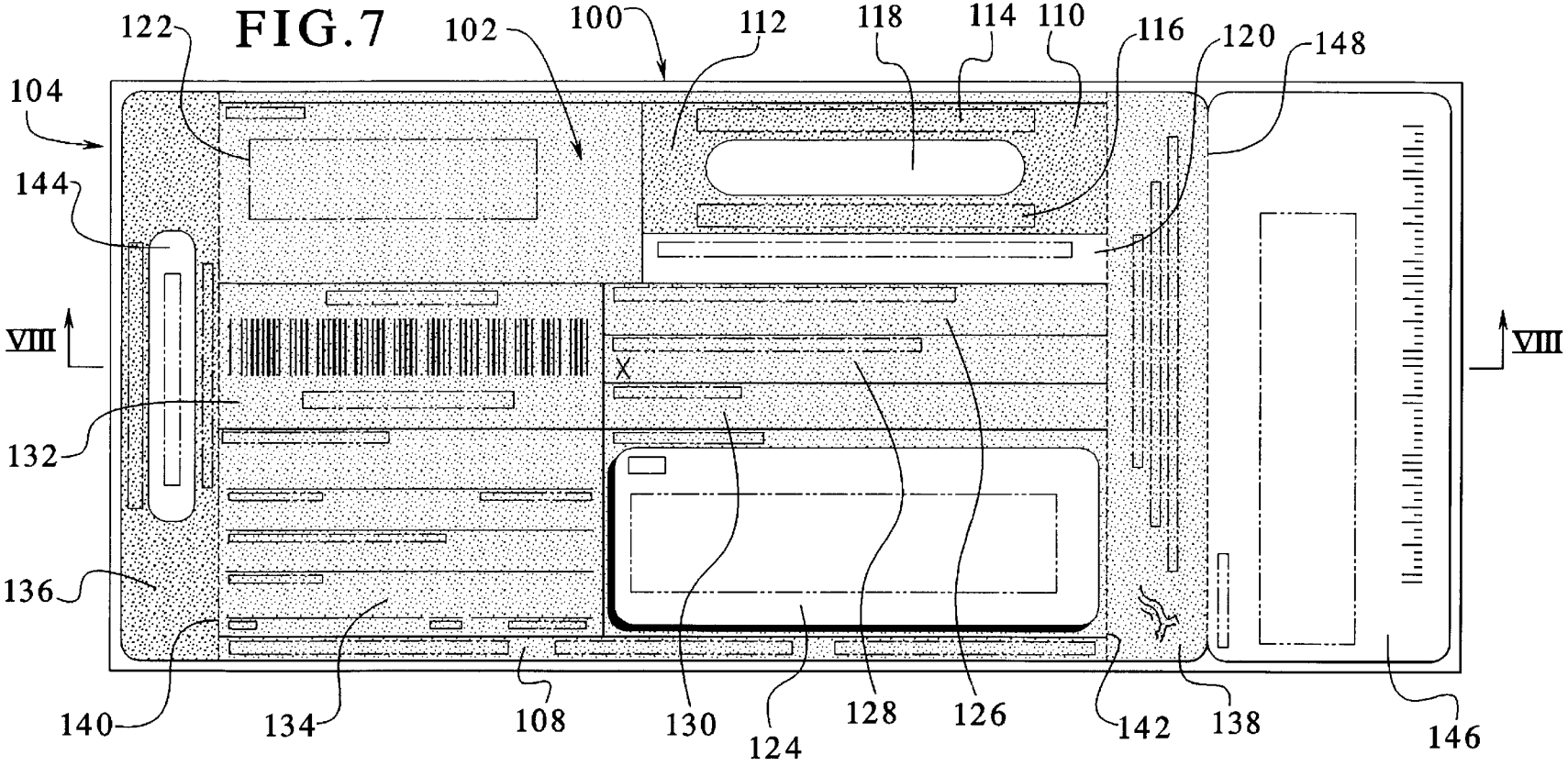
FIG. 7 illustrates a plan view of a front side of another embodiment of an assembly of the present invention.
Figure 8:
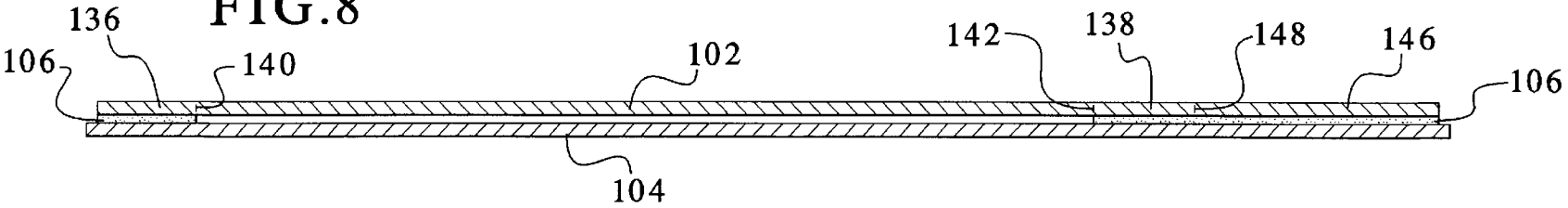
FIG. 8 illustrates a cross-sectional view taken generally along the line VIII—VIII of FIG. 7.
Figure 9:
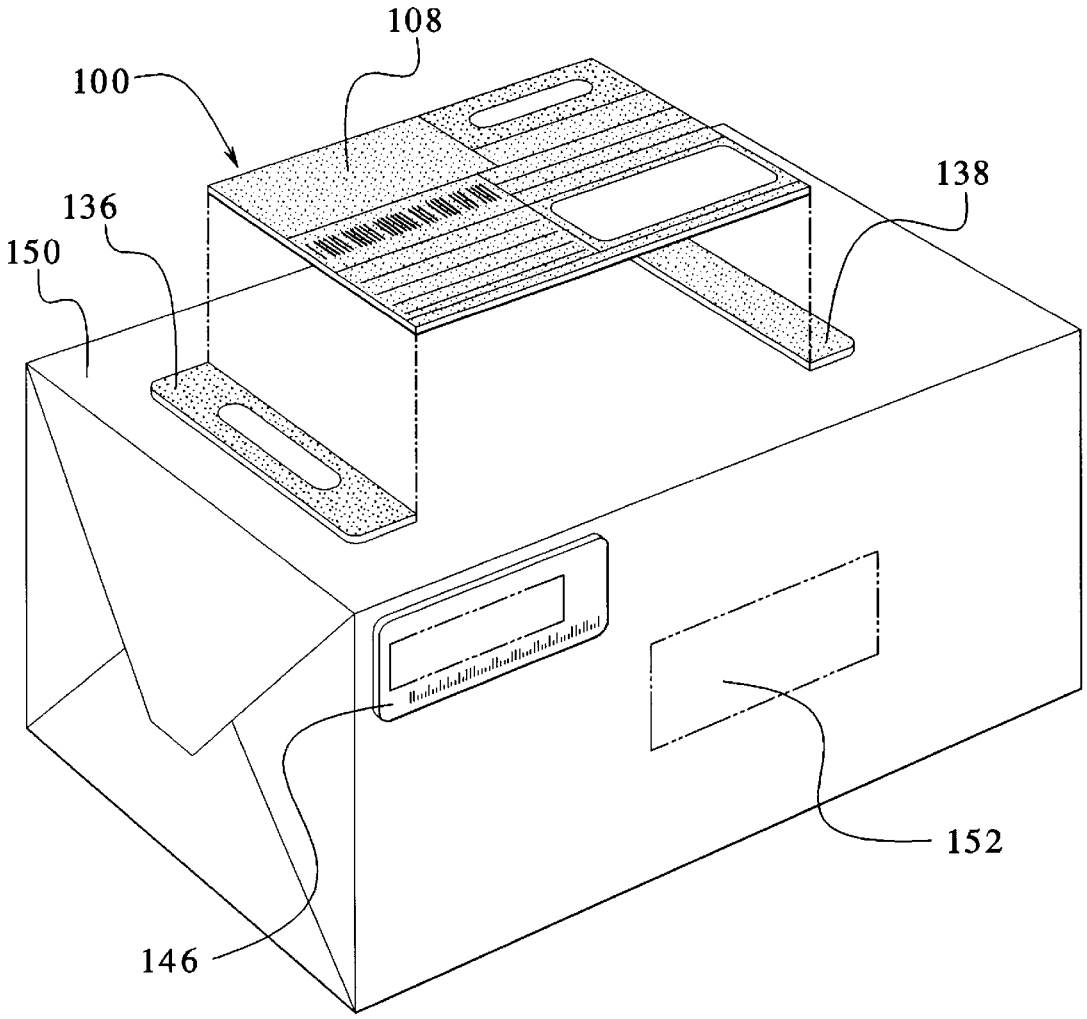
FIG. 9 illustrates a perspective view of an embodiment of the assembly as used on a package.

Referring now to FIGS. 7–9, an alternate embodiment of a mailing assembly 100 is illustrated. The mailing assembly 100 includes a first layer 102 and a second layer 104. The first layer 102 and the second layer 104 are separably attached via an adhesive 106 between selected portions of the two layers 102,104. The first layer 102 includes a plurality of separable parts including a return postcard 108 having an integrally formed designator section 110. The return postcard conforms with requirements for, for example, United States Postal Service Form 3811. The designator section 110 includes information necessary to comply with requirements for, for example, United States Postal Service Forms 3804, 3806, 3813, 3856 or the like. The designator section 110 heretofore has been implemented as a separate and distinct form apart from the return postcard 108. The unique arrangement of the return postcard 108 with the designator section 110 allows for incorporation of what previously required completion of two forms and subsequent attachment of two forms to, for example, a package to be delivered requiring special services for delivery thereof. As a result, use of the mailing assembly 100 of the present invention substantially simplifies and expedites the preparation of such a mailpiece requiring delivery by a special service, such as certified mail, return receipt for merchandise, insured mail, registered mail, and the like.

The designator section 110 includes a first area 112 that is distinctly colored from a remainder of the area. For example, the color of the first area 112 may be green to designate the generally recognized color for certified mail or may be brown to designate the generally recognized color for return receipt for merchandise, or the like. Within the first area 112, wording areas 114,116 may be provided to specifically denote the type of special service for which the mailing assembly is to be implemented. An article identifying number area 118 is provided within the designator section 110 to provide, preferably, a machine readable number associated with the mailpiece. This is particularly useful for tracking of the mailpiece before, during and after delivery by the special service.

A special instruction area 120 is also incorporated within the designator section 110. Both the article identifying number area 118 and the special instruction area 120 have a distinctly colored background to improve the machine readability of the information within these areas. The special instruction area 120 may include, for example, specific instructions such as "RESTRICTED DELIVERY", "ADDRESSEE'S ADDRESS REQUESTED", "RETURN RECEIPT REQUESTED" or the like. The return postcard 108 includes other information generally required within specific sections, such as sender information area 122, article addressee area 124, recipient name area 126, recipient signature area 128, date received area 130, machine readable document control area 132, and addressee address area 134.

On each side of the return postcard 128 are anchor portions 136,138. The anchor portions 136,138 are separable from the return postcard 128 by perforated tear lines 140, 142, respectively. The anchor portions 136,138 may also be printed with variable information or pre-printed information relating to the mail handling or information of a general nature. As shown in the anchor portion 136, an article identifying number area 144 is provided that may include a machine readable article identifying number related to the special delivery of the mailpiece for which the mailing assembly is used. The article identifying number area 144 may be implemented as a removable label from within the anchor portion 136 separable therefrom by die-cut lines, score lines, or the like. The anchor portions 136,138 are removably secured to the second layer 104 via the adhesive 106.

As further illustrated, an auxiliary label 146 may be provided and implemented in a number of fashions. For example, the auxiliary label 146 may act as a mailing label, a return address label, or the like. The auxiliary label 146 may be separable from a remainder of the mailing assembly 100 via a score line 148. Alternatively, the score line 148 may be implemented as a perforated tear line, die-cut lines or the like. As a result, the auxiliary label 146 is separable from the remainder of the mailing assembly 100 as well as from the second layer 104 with an adhesive back side for attachment to, for example, a mailpiece.

As illustrated in FIG. 9, the mailing assembly 100 is attached to a mailpiece 150 by removing the mail assembly 100 from the second layer 104 and attachment of the anchor portions 136,138 using the adhesive 106 on a back side of the anchor portions 136,138 for attachment to the mailpiece 150. The return postcard 108 is separable from the anchor portions 136,138 following delivery of the mailpiece 150 to, for example, confirm receipt of delivery of the mailpiece 150. As illustrated, the auxiliary label 146 is incorporated as a return address label. Alternatively, the auxiliary label 146 may be used as an addressee's label and incorporated in the area generally designated at 152 in FIG. 9.

Figure 10:
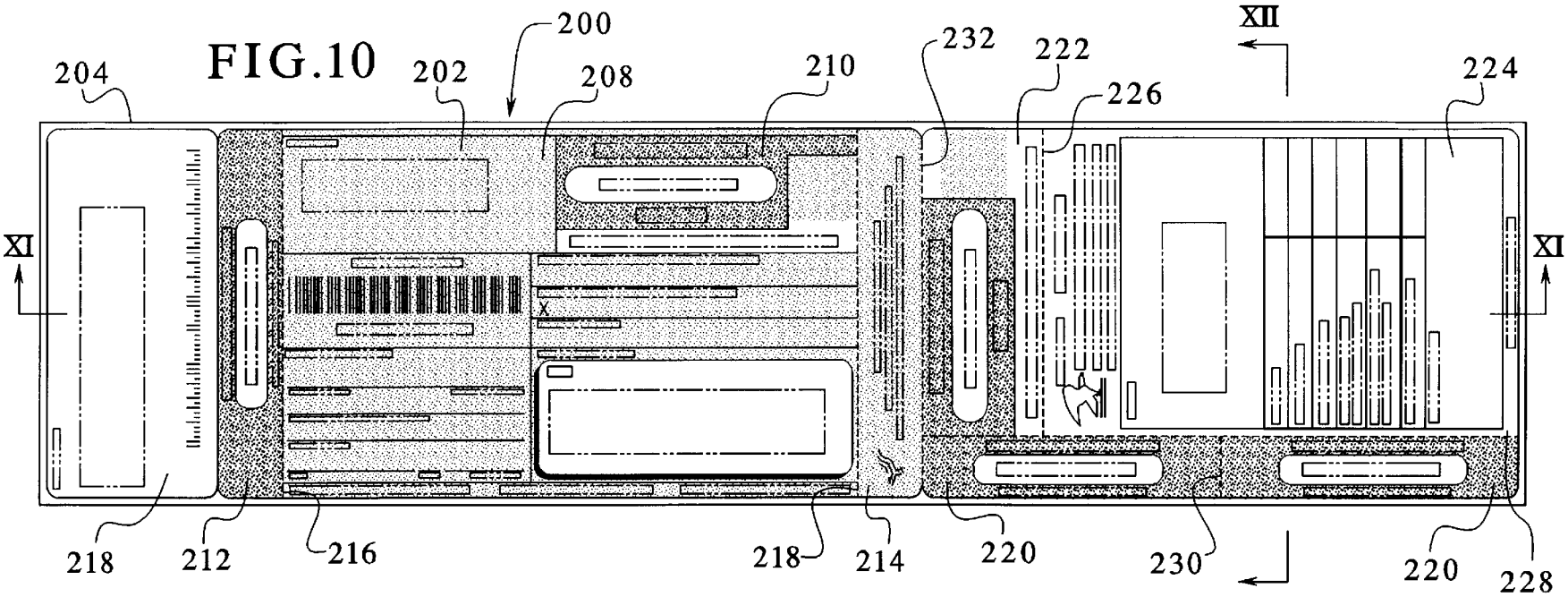
FIG. 10 illustrates a plan view of a front side of yet another embodiment of an assembly of the present invention.
Figure 11:
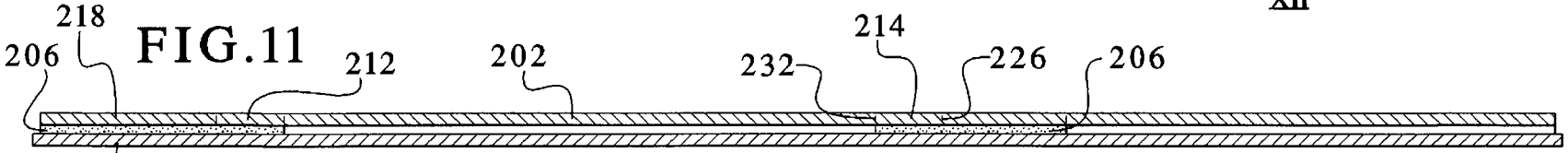
FIG. 11 illustrates a cross-sectional view taken generally along the line XI—XI of FIG. 10.
Figure 12:
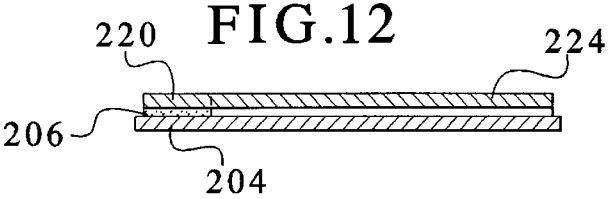
FIG. 12 illustrates a cross-sectional view taken generally along the line XII—XII of FIG. 10.

Referring now to FIGS. 10–12, an alternate embodiment of a mailing assembly 200 is generally illustrated. The assembly 200 incorporates a first layer 202 and a second layer 204 with an adhesive 206 in selected areas therebetween as generally illustrated in FIGS. 11 and 12. The first layer 202 of the mailing assembly 200 includes a return postcard 208 with an incorporated designator section 210. At each end of the return postcard 208 are anchor portions 212,214 separable by perforated tear lines 216,218, respectively. On a back side of each of the anchor portions 212,214 is the adhesive 206. The adhesive 206 provides for attachment of the first layer 202 to the second layer 204 and following removal of the first layer 202 from the second layer 204, the adhesive 206 beneath the anchor portions 212,214 allows for attachment of the first layer 202 to a mailpiece. An auxiliary label 218 is provided exterior to the anchor portion 212 and has the adhesive 206 on its back side. As a result, the auxiliary label 218 may be implemented as described with references to FIGS. 7–9.

The mailing assembly 200 also includes additional article identifying number areas 220 with the adhesive 206 on its back side for removable attachment from the second layer 204 and subsequent attachment of the article identifying number area 220 to a specific item as necessary. In addition, the mailing assembly 220 may further include an additional designator section 222 that substantially repeats the information in the designator section 210 for additional usage on the mailpiece on which the mailing assembly 200 is implemented.

Further, the mailing assembly 200 may include a receipt section 224. The receipt section 224 is a receipt for the sender of the mailpiece. The receipt section 224 generally includes information corresponding to, for example, United States Postal Service Form 3800. The receipt 224 is detachable from a remainder of a mailing assembly 200 via perforated tear lines 226,228. The perforated tear line 228 is also implemented to remove the article identifying number areas 220 from a remainder of the mailing assembly 200 and is separately detachable one from the other via the perforated tear line 230. In addition, the auxiliary designator section 222 may also be separable from a remainder of the assembly 200, namely the anchor portion 214, via the perforated tear line 232. The embodiment illustrated in FIG. 10 may be implemented similarly to the invention shown and described with reference to FIGS. 7–9. The return receipt 224 is typically removed for use by the sender as verification that the special service was requested and the amount paid for that special service.

Either of the mailing assemblies 100,200 may be incorporated in a series of forms continuously repeated. Therefore, the mailing assemblies 100 or 200 may be linked together such that they are incorporated as a continuous series of forms or, alternatively, a roll of forms, or the like.

The second layer 104 or 204 of the mailing assemblies 100 or 200, respectively, may include an area that is die-cut with a frozen label such that if duplex printing is implemented and variable information is simultaneously or subsequently printed on a back side of the return postcard, for example, then that information remains on the back side of the return postcard following removal of the second layer from a remainder of the mailing assembly 100,200.

Figure 13:
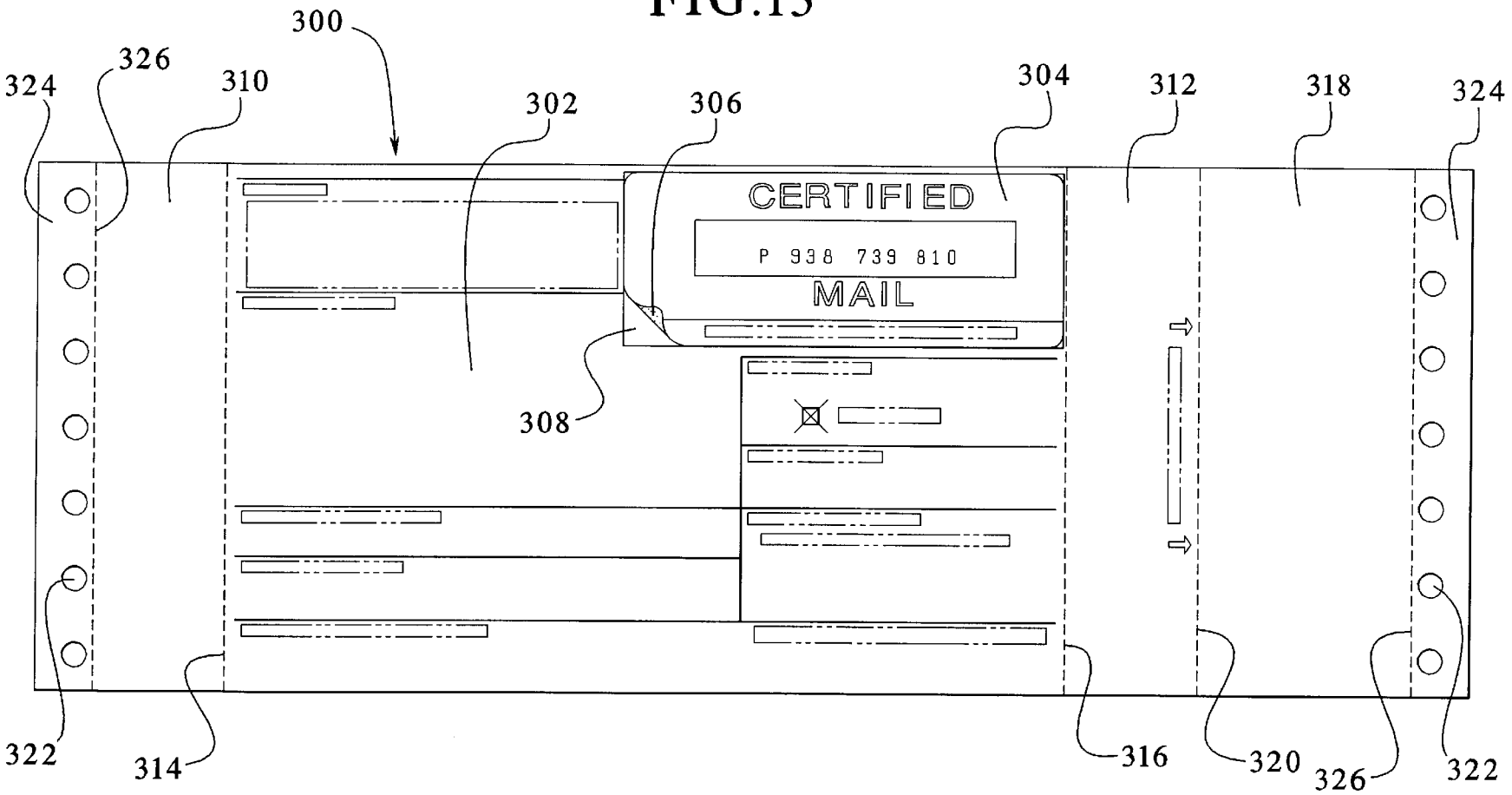
FIG. 13 illustrates a plan view of a front side of yet another embodiment of an assembly of the present invention.

Referring now to FIG. 13, yet another embodiment of a mailing assembly 300 is illustrated. The mailing assembly 300 includes a plurality of separable parts including a return postcard 302 having a removably attached integrally formed designator section 304. The return postcard 302 includes information to conform with the requirements for, for example, U.S. Postal Service Form 3811. The designator section 304 includes information necessary to comply with requirements for, for example, U.S. Postal Service Forms 3804, 3806, 3813, 3856 and the like.

The removably attached integrally formed designator section 304 has an adhesive layer 306 on the backside of the designator section 304. The backing layer 308 allows the designator section 304 and the adhesive layer 306 to be removed from the return postcard 302. This provides the advantage of having a removable designator section on the return postcard form itself whereby the designator section 304 may be removed from the return postcard 302 and applied to a mailpiece, for example. As a result, use of the mailing assembly 300 of the present invention substantially simplifies and expedites the preparation of such a mailpiece requiring delivery by a special service, such as certified mail, return receipt for merchandise, insured mail, registered mail and the like.

On each side of the return postcard 302 are anchor portions 310,312. The backsides of anchor portions 310,312 contain an adhesive (not shown) for attaching the mailing assembly 300 to a mailpiece. The return postcard 302 contains no adhesive. The anchor portions 310,312 are separable from the return postcard 302 by tear lines 314,316, respectively, so that after delivery of the mailpiece, the return postcard 302 may be removed from anchor portions 310,312. The anchor portions 310,312 may also be printed with variable information or pre-printed information relating to the mail handling or information of a general nature.

As further illustrated, an auxiliary label 318 may also be provided and implemented in a number of fashions. For example, the auxiliary label 318 may act as a mailing label or as a return address label or the like. The auxiliary label 318 may be separable from a remainder of the mailing assembly 300 via a scored line 320. Alternatively, the scored line 320 may be implemented as a tear line, die cut line or the like. As a result, the auxiliary label 318 is separable from the remainder of the mailing assembly 300.

As further illustrated, the embodiment shown in FIG. 13 may have a plurality of tracking holes 322 in the edges thereof for use in, for example, a printer having tracking wheels to advance a plurality of the mailing assemblies connected one to another and separable via tear lines between adjacent mailing assemblies. The tracking holes 322 are located on a tracking strip 324. The tracking strips 324 may be detached from a remainder of the mailing assembly 300 by tear lines 326.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A special service mailing assembly comprising:

a backing sheet;

a layer attached to the backing sheet by an adhesive wherein the layer includes a return postcard and a designator section indicative of a special service wherein the designator section is contained within exterior sides that define the return postcard and further wherein the designator section is removably attached to the return postcard.

2. The special service mailing assembly of claim 1 further comprising:

a first anchor portion associated with the layer extending outside one of the exterior sides of the return postcard wherein the first anchor portion has the adhesive on a back side of the first anchor portion removably attached to the backing sheet.

3. The special service mailing assembly of claim 1 further comprising:

an area within the designator section that has a machine readable code.

4. The special service mailing assembly of claim 1 wherein the designator section is distinctly colored from a remainder of the return postcard.

5. The special service mailing assembly of claim 1 wherein the special services includes certified mail, registered mail, insured mail, COD, or return receipt for merchandise mail.

6. The special service mailing assembly of claim 1 further comprising:

a second anchor portion attached to the return postcard outside one of the exterior sides of the return postcard wherein the second anchor portion has the adhesive on a back side of the return postcard.

7. The special service mailing assembly of claim 1 further comprising:

a tear line separating the first anchor portion from the return postcard.

8. The special service mailing assembly of claim 1 further comprising:

an auxiliary label connected to the return postcard.

9. The special service mailing assembly of claim 8 further comprising:

a tear line separating the auxiliary label from the return postcard.

10. The special service mailing assembly of claim 8 further comprising:

an adhesive on a back side of the auxiliary label.

11. The special mailing assembly of claim 1 further comprising:

a tracking strip extending outside one of the exterior sides of the return postcard.

12. A method for preparing a mailpiece for delivery by a special service, the method comprising the steps of:

providing a backing sheet;

attaching a layer including a return postcard to the backing sheet wherein the return postcard has a removably attached special service designation section within exterior sides that define the postcard;

removing the layer from the backing sheet; and attaching the layer to the mailpiece to effect the delivery by the special service;

removing the special service designation section; and attaching the special service designation section to the mailpiece to effect the delivery by the special service.

13. The method of claim 12 further comprising the step of:

providing an anchor portion adjacent the return postcard.

14. The method of claim 12 further comprising:

providing an auxiliary label adjacent the postcard.

15. A mailing label for preparing a mailpiece for delivery by a special service, the label comprising:

a backing layer; and a label including a first portion with adhesive backing and a second portion without adhesive backing wherein the second portion includes a return postcard having a designation section wherein the designation section is distinctly colored from a remainder of the return postcard to identify a type of the special service and further wherein the designator section is removably attached to the return postcard.

16. The label of claim 15 further comprising:

an auxiliary label attached to the first portion of the label, the auxiliary label having an adhesive backing.

17. The label of claim 15 further comprising:

a receipt attached to the label wherein the receipt has no adhesive backing.

18. The label of claim 15 further comprising:

a tear line arranged for separating the first portion from the second portion.

19. The label of claim 15 wherein the designation section is suitable for designating certified mail, insured mail, registered mail or return receipt for merchandise.

20. The label of claim 15 further comprising:

an additional special designation label exterior to the return postcard, the additional special designation label having an adhesive back side.

* * * * *